US005730337A

United States Patent [19]

Carlile, Jr. et al.

[11] Patent Number: 5,730,337

[45] Date of Patent: Mar. 24, 1998

[54] DISPENSING FITMENT WITH DISCRETE SNAP BEAD MEMBERS ENGAGING CONTAINER NECK FINISH AND ASSEMBLY INCLUDING FITMENT, CONTAINER, AND CAP

[75] Inventors: Dewey R. Carlile, Jr., Belmont, Ohio; Phillip M. Sanderson, Wheeling, W. Va.; Victor T. Exner, Bellaire, Ohio

[73] Assignee: RXI Plastics, Inc., Triadelphia, W. Va.

[21] Appl. No.: 644,839

[22] Filed: May 10, 1996

[51] Int. Cl.[6] ..... B65D 47/00

[52] U.S. Cl. ..... 222/565; 222/570; 220/256; 220/784; 220/793

[58] Field of Search ..... 222/545, 565, 222/570; 220/256, 367.1, 784, 793

[56] References Cited

U.S. PATENT DOCUMENTS

| | | | |
|---|---|---|---|
| 1,811,080 | 6/1931 | Gadke . | |
| 1,811,113 | 6/1931 | Derby . | |
| 2,281,649 | 5/1942 | Williams | 215/38 |
| 2,403,511 | 7/1946 | Enkur | 215/38 |
| 2,753,082 | 7/1956 | Kovacich et al. | 222/129 |
| 3,194,455 | 7/1965 | Castelli | 222/545 |
| 3,675,811 | 7/1972 | Artz | 220/784 X |
| 3,964,635 | 6/1976 | Ludder | 220/78 X |
| 4,076,152 | 2/1978 | Mumford | 222/545 |
| 4,961,521 | 10/1990 | Eckman | 222/565 X |
| 5,111,978 | 5/1992 | Mengeu | 222/545 |
| 5,551,608 | 9/1996 | Moore et al. | 220/256 X |

*Primary Examiner*—Joseph Kaufman

*Attorney, Agent, or Firm*—Richard V. Westerhoff; Eckert Seamans Cherin & Mellott, LLC

[57] ABSTRACT

A dispensing fitment has a plurality of angularly spaced discrete retaining bead members extending circumferentially around the internal wall surface of a skirt on the fitment. Thinned wall sections of the skirt between the discrete retaining bead members elastically circumferentially expand to break the hoop strength of the skirt and allow the discrete retaining bead members to snap over and engage an external bead on the container neck. Thin, flexible, radially outwardly extending tabs secure the fitment within a cap for initial application to the container as an assembly with the fitment remaining on the container with subsequent removal of the cap.

16 Claims, 4 Drawing Sheets

DISPENSING FITMENT WITH DISCRETE SNAP BEAD MEMBERS ENGAGING CONTAINER NECK FINISH AND ASSEMBLY INCLUDING FITMENT, CONTAINER, AND CAP

BACKGROUND OF THE INVENTION

1. Field of the Invention

This invention relates to closable containers for dispensing product and in particular a dispensing fitment and its manner of attachment to the container neck.

2. Background Information

A common type of container for dispensing dry or liquid product has a separate fitment which extends over the container opening and has one or more dispensing openings. Typically, the fitment is retained on the container neck by a continuous annular bead on the internal surface of a cylindrical skirt which snaps over and engages a continuous annular bead on the external surface of the container neck. A removable cap is then screwed on or pushed on over top of the fitment to seal the container between uses.

It was formerly common practice to secure the fitment to the container first, separately of the cap, using one machine, and then to apply the cap using a second machine. Typically, the fitment was placed on the container and a roller was passed over the fitment so that the continuous annular bead in the fitment progressively engaged the continuous external bead on the container neck. This accommodated aggressive interference between the beads on the fitment and the container neck which assured retention of the fitment once applied.

More recently, efforts have been made to apply the fitment and cap simultaneously as an assembly to eliminate the separate step and apparatus for fitment application required by the two step process. The fitment is temporarily retained in the cap, such as by the axial ribs and radial flanges disclosed in U.S. Pat. No. 5,111,978 which engage the threads in the cap, or for instance by axial projections on the cap end wall which engage the periphery of, or an aperture in, the fitment. As the assembly is applied to the container, the fitment engages the neck with a grip which exceeds that of the cap, so that upon subsequent removals of the cap, the fitment remains in place on the container neck.

Typically, two types of capping machines are used to apply the cap and fitment assembly in a one step operation. In the in line wheel style capper, successive rotating wheels engage the skirt of the threaded cap to screw it down onto the container neck thereby forcing the fitment down into engagement with the container finish. It appears that the fitment is still rolled across the mouth of the container, but without direct application of an axial force to the fitment the interference between the beads on the fitment and container neck can not be as aggressive. This creates a delicate balance between being able to seat the fitment on the container and to retain it in place when the cap is removed.

The second type of capper is the chuck type which grips the cap and spins it onto the container thread. This capper applies a more direct axial force which requires the fitment skirt with its continuous snap bead to stretch in order to snap over the bead on the container neck. While a more aggressive interference can be used with this capper, a balance must still be struck between being able to apply the fitment through force exerted on the cap and to retain it on the container during repeated removal of the cap.

There is a need therefore for an improved dispensing fitment for containers and especially one that can be applied simultaneously with the container cap.

There is a particular need for such an improved fitment which can be applied to the container easily and is retained on the container with a high degree of reliability despite repeated application and removal of the cap.

SUMMARY OF THE INVENTION

These needs and others are satisfied by the invention which is directed to a dispensing fitment for a container having an external bead extending circumferentially around the neck adjacent a container opening, wherein the fitment has an end wall with at least one dispensing opening and a skirt extending axially from and continuously around the periphery of the end wall. The fitment has a plurality of discrete retainer bead members extending circumferentially around the inner surface of the skirt. Between the discrete retaining bead members are radially thinned wall sections of the skirt which elastically expand to allow the discrete retaining bead members to snap over the external bead on the container. These thin walled sections then elastically contract to retain the discrete retainer bead members in engagement with the external bead on the neck of the container. The thinned walled sections of the fitment skirt are no more than about 80% of the radial thickness of the skirt at the discrete retaining bead members and preferably about 60%. Also, the discrete retaining bead members extend circumferentially in the aggregate around no more than about half of the internal surface of the fitment and preferably there are four such discrete retaining bead members each extending circumferentially about 45°. As another aspect of the invention, radially outward projections on the fitment, preferably in the form of flexible tabs, engage container engaging means, preferably in the form of threads, inside the cap so that the fitment may be assembled inside the cap for application to the container as an assembly. When the cap is applied to the container, with the fitment secured inside, the thin walled sections of the skirt of the fitment allow the skirt at the discrete retaining bead members to flex outward so that the discrete retaining bead members snap over the external beads on the container neck. This permits the fitment to be secured to the container neck with an aggressive interference so that when the cap is removed the fitment remains in place on the container; yet the fitment easily and consistently engages the neck finish.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
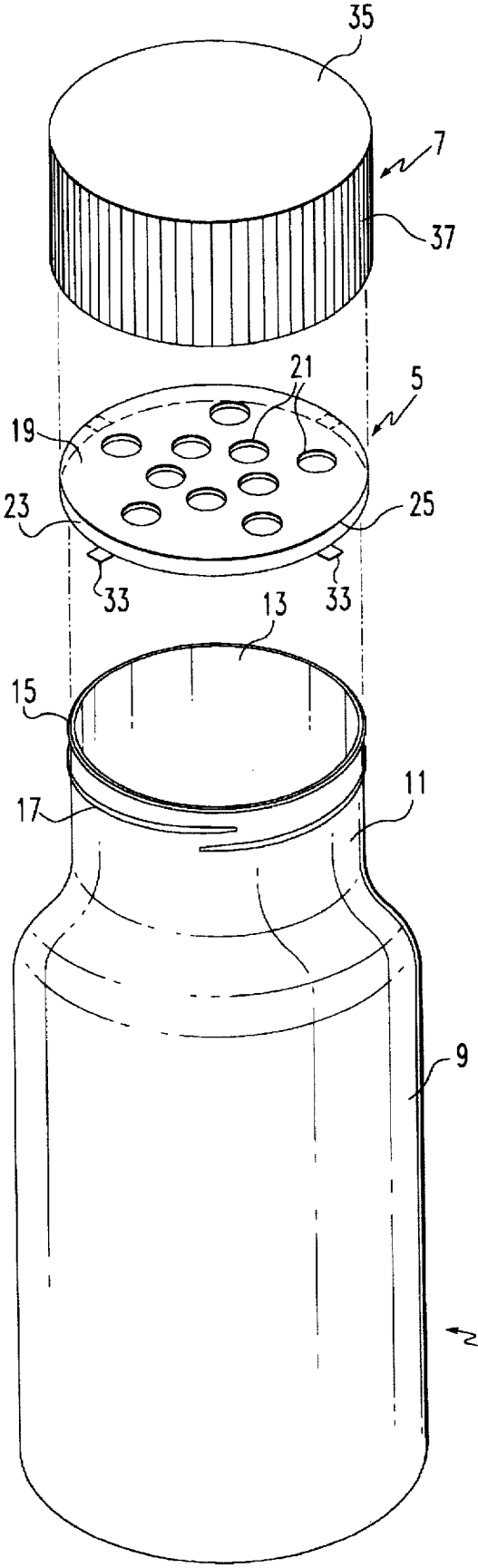
FIG. 1 is an exploded isometric view of packaging in accordance with the invention, including the dispensing fitment, the container to which it is applied, and a cover cap.

FIG. 1 illustrates packaging in accordance with the invention for storing and dispensing dry or liquid product. The packaging 1 includes a container 3, a dispensing fitment 5, and a cap 7. The container has a body portion 9 with a neck 11 defining a container opening 13. Just below the opening 13 on the neck 11 of the container there is an external bead 15 extending circumferentially around the neck 11. Also, on the neck 11 and spaced below the opening 13 by the external bead 15 is an engagement device in the form of threads for securing a cap to the container.

Figure 2:
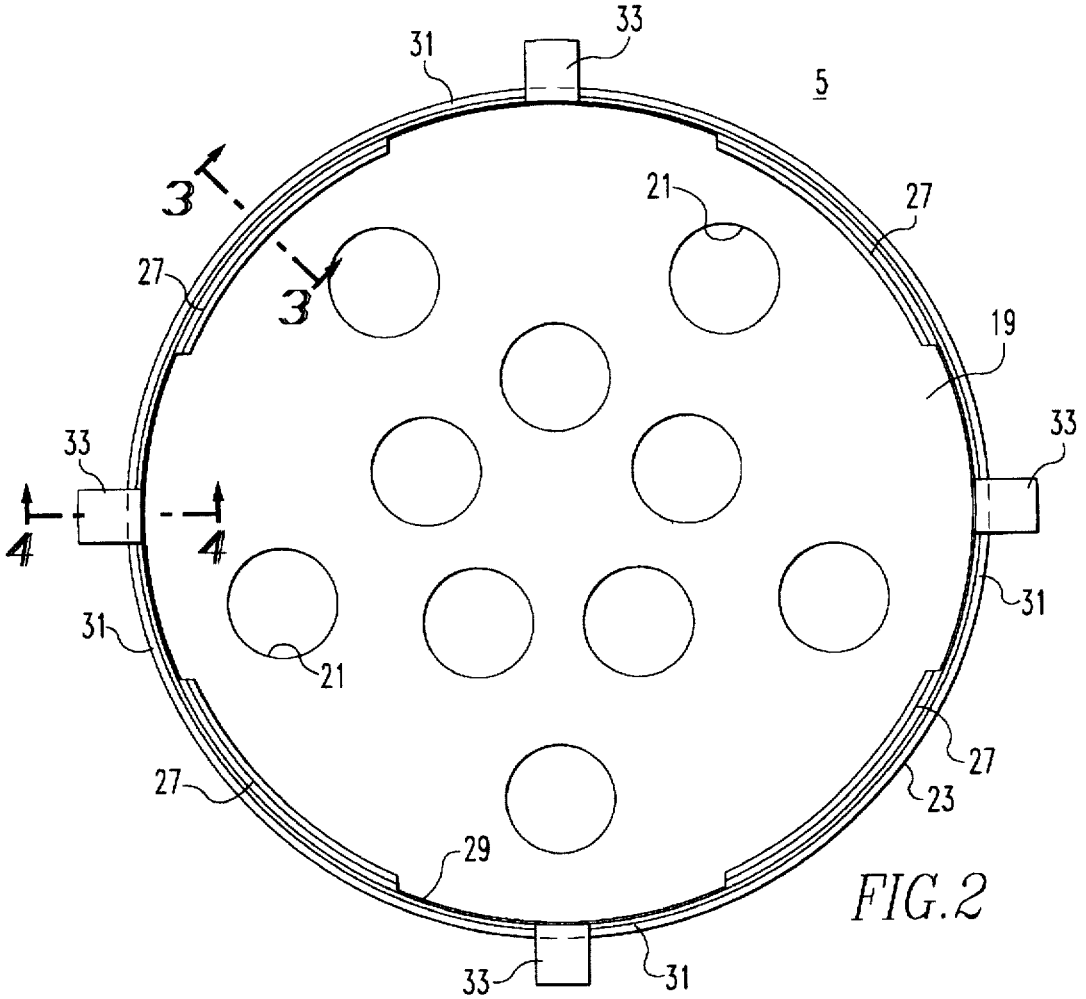
FIG. 2 is a bottom plan view of the fitment of FIG. 1.
Figure 3:
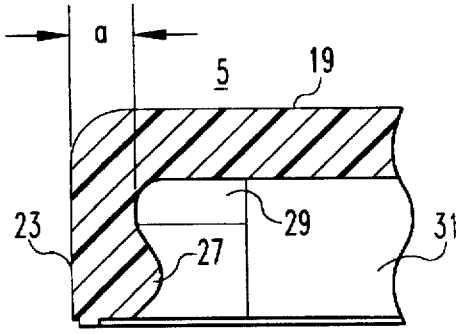
FIG. 3 is a partial axial sectional view through a portion of the fitment of FIG. 2 taken at one of the discrete beads along the line 3—3 in FIG. 2.
Figure 4:
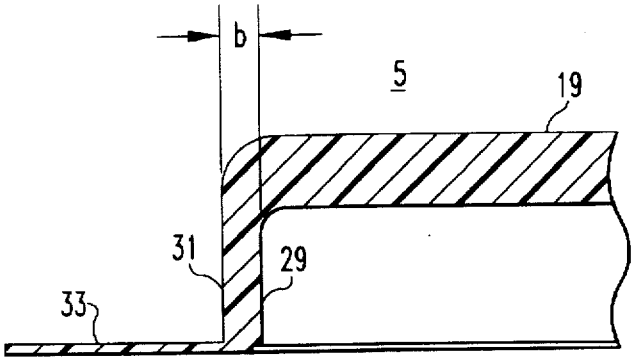
FIG. 4 is a partial axial sectional view similar to FIG. 3 but taken through a thin walled section along the line 4—4 in FIG. 2.

The dispensing fitment 5, includes a circular end wall 19 having at least one dispensing opening 21 extending therethrough. A skirt 23 extends axially from and continuously around a periphery 25 of the end wall 19. As best seen in FIGS. 2–4, there are a number of discrete retaining bead members 27 extending circumferentially around the cylindrical inner surface 29 of the fitment skirt 23. The skirt 23 has thinned wall sections 31 between the discrete retaining bead members 27. Preferably, these thinned wall sections 31 extend the full circumferential distance between the discrete retaining bead members 27. As can be seen from FIGS. 3 and 4, the skirt 23 of the fitment has a first wall thickness "a" at the discrete retaining bead members 23 and a second thinner wall having a radial dimension "b" at the thinned wall sections 31.

In the illustrative embodiment of the invention, there are four discrete retaining bead members 27 each of which extends about 45° circumferentially around the internal surface 29 of the skirt 23. These discrete retaining bead members 27 are equiangularly spaced on the internal surface 29 so that the thinned wall sections 31 are also 4 in number and can be equiangularly spaced. In this illustrative embodiment, these thinned wall sections 31 extend the full circumferential distance between the discrete retaining bead members 27. Thus, in the preferred embodiment, these thinned wall sections 31 each extend about 45° circumferentially.

The fitment 5 also has a plurality of radially outwardly extending projections, preferably in the form of thin, flexible tabs 33, which as will be seen, retain the fitment within the cap 7 for initial application to the container 3. The cap 7 has an imperforate end wall 35 and a cylindrical skirt 37 extending axially from the end wall 35. An attachment device, preferably internal threads 39, are provided for securing the cap to the complimentary threads 17 on the container neck. (FIG. 5.)

Figure 5:
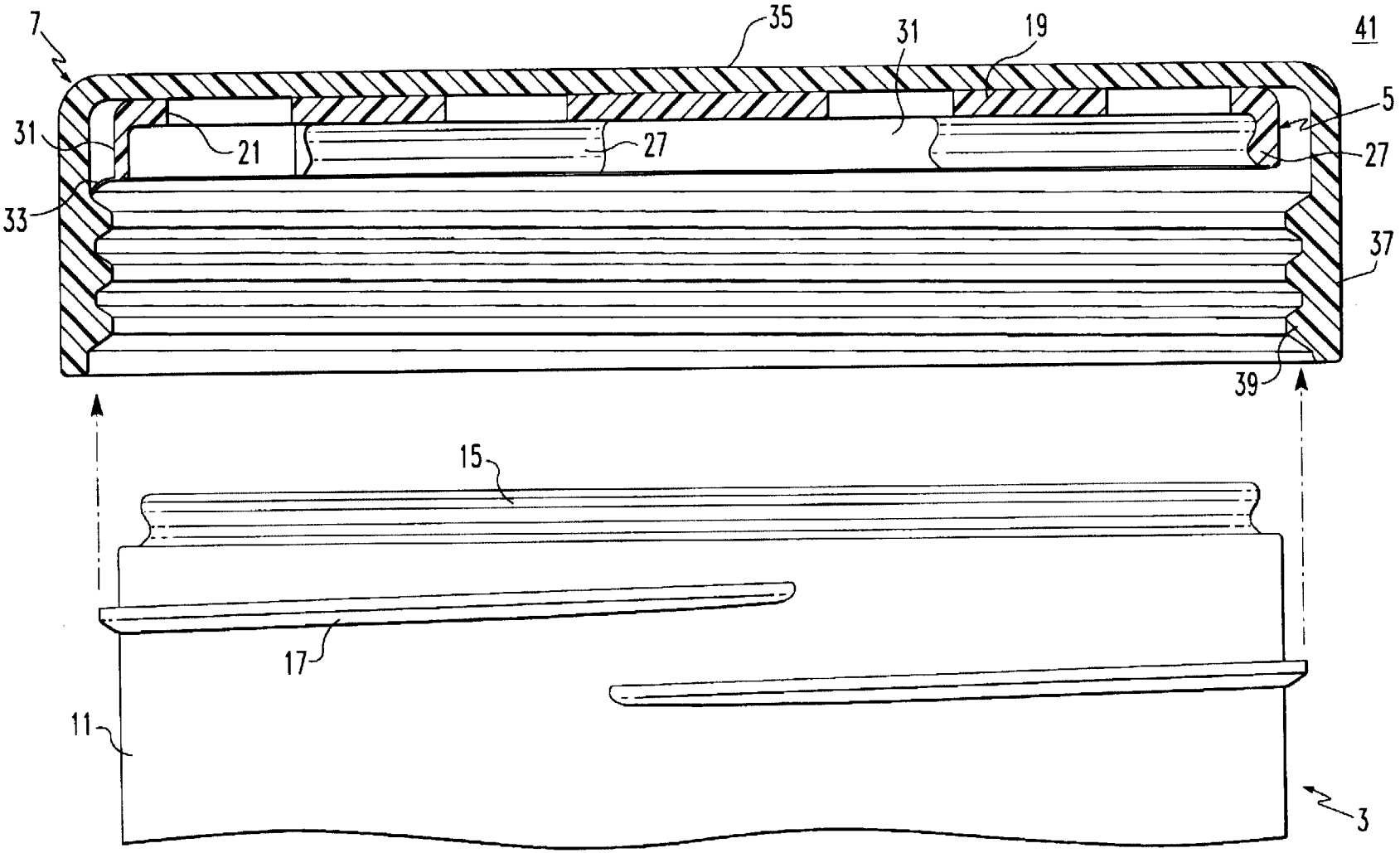
FIG. 5 is a longitudinal sectional view through packaging in accordance with the invention showing the fitment and cap assembly in place for application to the container.
Figure 6:
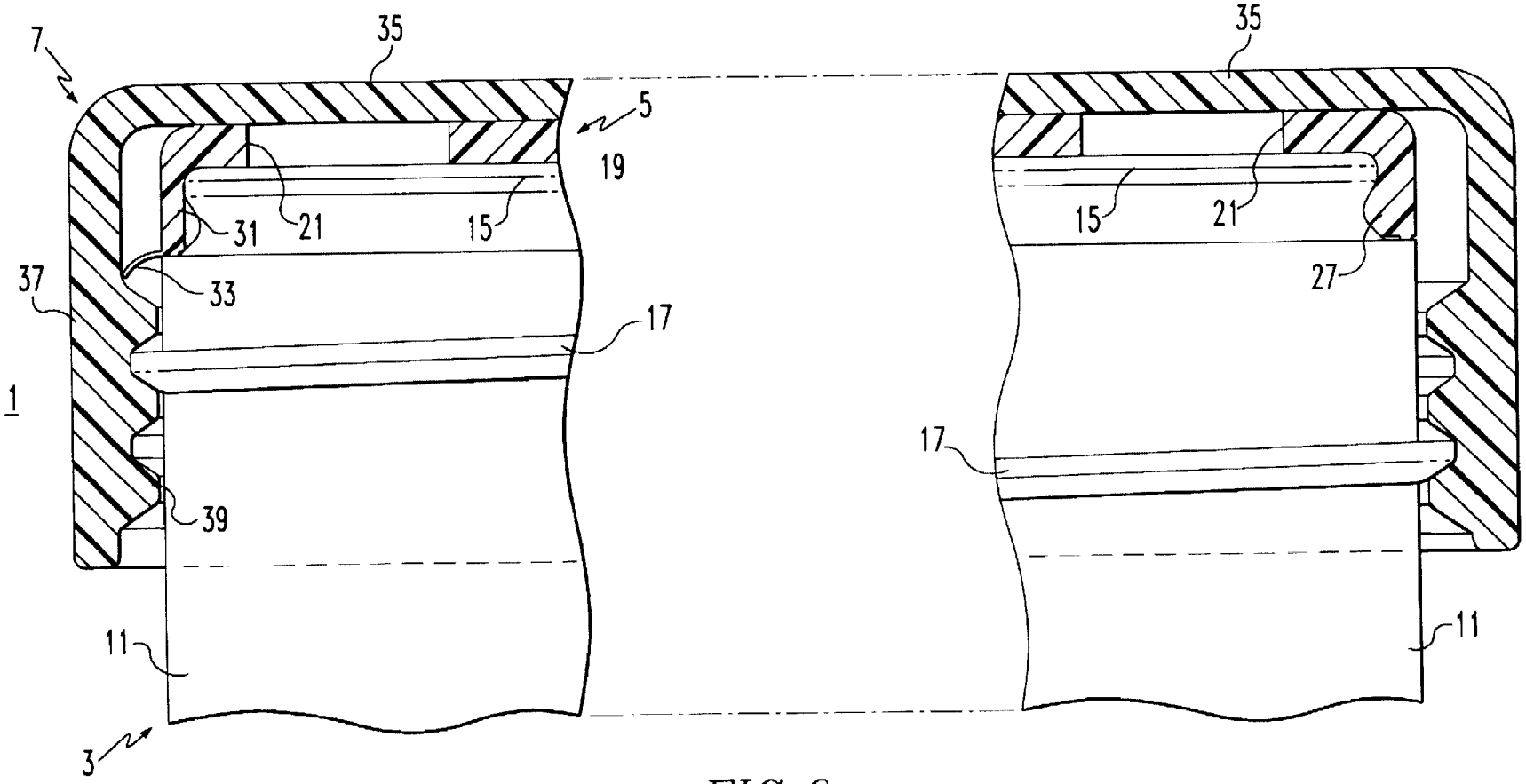
FIG. 6 is a longitudinal sectional view through packaging in accordance with the invention showing the cap and fitment in place on the container with the center parts removed and the remaining parts shown in enlarged scale.

Prior to application to the container, an assembly 41 is formed by inserting the fitment 5 inside the cap 7 as shown in FIG. 5. The flexible tabs 33 deflect to pass over the threads 39 in the cap, and then being bent downward, provide resistance which maintains the fitment 5 within the cap 7. This assembly 41 is then applied, for instance using either type of widely used capping machine previously described, to the container 3. As the cap 7 is screwed onto the container neck 11 with the threads 39 engaging the threads 17 on the container, the discrete retaining bead members 27 engage the external bead 15 on the neck of the container as shown in FIG. 6. The axial force generated by the engagement of the threads on the cap and container wedges the discrete retaining bead members outwardly. This stretching of the skirt 23 of the fitment 5 is facilitated by the thinned wall sections 31 which elastically expand. The discrete retaining bead members 27 then snap over the external bead 15 on the container neck and the thinned wall sections 31 of the fitment skirt elastically contract to pull the discrete retaining bead members 39 inward under the external bead 15 on the neck of the container 3. Because of the elasticity of the thinned wall sections 31, the inner diameter of the discrete retaining bead members 27 can be made smaller than the external radial dimension of the bead 15 on the neck of the container by an amount which produces aggressive interference to firmly secure the fitment to the container neck with the end wall 19 extending across the opening 13. This interference is such that when the cap 7 is removed from the container neck, the fitment remains secure in place on the container. Product can then be dispensed from the container through the dispensing openings 21. The cap 7 can be replaced to seal the container between uses.

The fitment 5 is made from a compliant resin, such as for example a high density or a low density polyethylene. Other such compliant resins such as, for example, polypropelene could also be used. The thinned wall sections 31 of the fitment skirt 23 break the hoop strength of the skirt which allows it to elastically expand until the discrete retaining bead members 27 snap over the external bead 15 on the container neck. The wall thickness "b" of the thinned wall sections 31 of the fitment skirt 23 is no more than about 80% of the radial thickness "a" of the skirt at the discrete retaining bead members 27, and preferably is approximately 60%. For example, in the illustrative fitment, the wall thickness "a" is about 22 mills and the wall thickness "b" is about 36 mills. Other numbers of discrete retaining bead members could be used, although 4 has been found to work especially well.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A dispensing fitment for a container having a neck defining a container opening and an external bead extending circumferentially around said neck, said dispensing fitment comprising:

an end wall having at least one dispensing opening therethrough;

a skirt extending axially from and continuously around a periphery of said end wall; and a plurality of circumferentially spaced discrete retaining bead members extending circumferentially on an internal surface of said skirt and having an internal radius smaller than an external radius of said external bead on said container, said skirt having a first radial wall thickness between said discrete retaining bead members and said end wall, and having radially thinned wall sections between said circumferentially spaced discrete retaining bead members having a second radial wall thickness which is less than said first radial wall thickness, said thinned wall sections elastically expanding to allow said discrete retaining bead members to snap over said external bead on said container and then elastically contracting to retain said discrete retaining bead members under said external bead on the neck of the container.

2. The fitment of claim 1 wherein said second radial wall thickness more than about 80% of said first radial wall thickness.

3. The fitment of claim 2 wherein said plurality of discrete retaining bead members extend circumferentially in aggregate no more than about ½ way around said internal surface of said skirt.

4. The fitment of claim 3 wherein said thinned wall sections extend circumferentially substantially fully between said discrete retaining bead members.

5. The fitment of claim 4 wherein said plurality of discrete retaining bead members comprises four retaining bead members.

6. The fitment of claim 3 wherein said plurality of discrete retaining bead members comprises four discrete retaining bead members.

7. The fitment of claim 1 wherein said plurality of discrete retaining bead members extend circumferentially no more than about ½ way around said internal surface of said skirt.

8. The fitment of claim 7 wherein said plurality of discrete retaining bead members comprises four discrete retaining bead members each extending circumferentially about 45° around said internal surface of said skirt.

9. The fitment of claim 1 wherein said plurality of discrete retaining bead members comprise four discrete retaining bead members.

10. The fitment of claim 1 adapted for use with a cap having circumferentially extending internal engagement means and which is applied over said fitment and removably engages external engagement means on said container spaced by said external bead on said neck of said container from said opening, said fitment having retainer means releasably engaging said internal engagement means on said cap until said cap with said fitment is first applied to said container and said discrete retaining bead members engage said external bead on said container neck.

11. The fitment of claim 10 wherein said internal engagement means on said cap and said external engagement means on said container comprise threads, and wherein said retainer means on said fitment comprise radially outwardly extending tabs which engage said threads on said cap.

12. In combination:

a container having a neck defining an opening, an external bead extending circumferentially around said neck, and external threads spaced from said opening by said external bead;

a fitment comprising:

an end wall having at least one dispensing opening therethrough;

a skirt extending axially from and continuously around a periphery of said end wall; and a plurality of circumferentially spaced discrete retaining bead members extending circumferentially on an internal surface of said skirt, said skirt having a first radial wall thickness between said discrete retaining bead members and said end wall, and having thinned wall sections between said circumferentially spaced discrete retaining bead members having a second radial wall thickness which is less than said first radial wall thickness; and a screw cap having internal threads removably applied to said container over said fitment and engaging said external threads on said neck.

13. The combination of claim 12 wherein said fitment further has radially outwardly extending projections engaging said internal threads on said cap for releasably retaining said fitment in said screw cap until said cap is applied to said container neck a first time and said discrete retaining bead members engage said external bead on said container neck.

14. The combination of claim 13 wherein said projections comprise tabs extending radially outward from said fitment.

15. The combination of claim 14 wherein said plurality of said discrete retaining bead members comprise four discrete retaining bead members and said tabs comprise four tabs.

16. The combination of claim 15 wherein said four tabs project radially outward from said thinned wall sections of said skirt.

* * * * *

UNITED STATES PATENT AND TRADEMARK OFFICE

CERTIFICATE OF CORRECTION

PATENT NO. : 5,730,337

DATED : March 24, 1998

INVENTOR(S) : DEWEY R. CARLILE, JR., PHILLIP M. SANDERSON and VICTOR T. EXNER

It is certified that error appears in the above-identified patent and that said Letters Patent is hereby corrected as shown below:

Column 4, line 55, delete "radially".

Column 4, line 66, after "thickness" insert --is no--.

Signed and Sealed this

Twenty-second Day of June, 1999

*Attest:*

Q. TODD DICKINSON

*Attesting Officer*

*Acting Commissioner of Patents and Trademarks*